US006993479B1

(12) United States Patent
Bichsel

(10) Patent No.: US 6,993,479 B1
(45) Date of Patent: Jan. 31, 2006

(54) METHOD FOR THE COMPRESSION OF RECORDINGS OF AMBIENT NOISE, METHOD FOR THE DETECTION OF PROGRAM ELEMENTS THEREIN, AND DEVICE THEREOF

(75) Inventor: Martin Bichsel, Bertschikon (CH)

(73) Assignee: Liechti AG, (CH)

( * ) Notice: Subject to any disclaimer, the term of this patent is extended or adjusted under 35 U.S.C. 154(b) by 0 days.

(21) Appl. No.: 09/102,939

(22) Filed: Jun. 23, 1998

(30) Foreign Application Priority Data

Jun. 23, 1997 (CH) ..... 1520/97

(51) Int. Cl.
*G10L 21/02* (2006.01)

(52) U.S. Cl. ..... 704/226; 704/225; 704/500; 381/71.14; 381/371

(58) Field of Classification Search ..... 904/201, 904/224, 227, 228; 704/200, 201, 225, 226, 704/500–504
See application file for complete search history.

(56) References Cited

U.S. PATENT DOCUMENTS

| | | | | | |
|---|---|---|---|---|---|
| 3,919,479 | A | | 11/1975 | Moon et al. | 179/1 |
| 4,061,875 | A | * | 12/1977 | Freifeld et al. | 381/72 |
| 4,450,531 | A | | 5/1984 | Kenyon et al. | 364/604 |
| 4,628,529 | A | * | 12/1986 | Borth et al. | 381/94.3 |
| 4,630,300 | A | * | 12/1986 | Kang et al. | 704/205 |
| 4,630,305 | A | * | 12/1986 | Borth et al. | 381/94.3 |
| 4,747,143 | A | * | 5/1988 | Kroeger et al. | 704/225 |
| 4,933,973 | A | * | 6/1990 | Porter | 704/233 |
| 4,991,213 | A | * | 2/1991 | Wilson | 704/207 |
| 5,012,519 | A | * | 4/1991 | Adlersberg et al. | 704/226 |
| 5,023,929 | A | | 6/1991 | Call | |
| 5,027,410 | A | * | 6/1991 | Williamson et al. | 381/320 |
| 5,579,124 | A | * | 11/1996 | Aijala et al. | 386/96 |
| 5,633,981 | A | * | 5/1997 | Davis | 704/230 |
| 5,754,798 | A | * | 5/1998 | Uehara et al. | 395/284 |
| 5,765,126 | A | * | 6/1998 | Tsutsui et al. | 704/200.1 |
| 5,790,671 | A | * | 8/1998 | Cooper | 381/57 |
| 5,812,965 | A | * | 9/1998 | Massaloux | 704/205 |
| 5,826,230 | A | * | 10/1998 | Reaves | 704/233 |
| 5,835,851 | A | * | 11/1998 | Rasmusson et al. | 455/79 |
| 5,872,852 | A | * | 2/1999 | Dougherty | 381/57 |
| 5,901,246 | A | * | 5/1999 | Hoffberg et al. | 382/209 |
| 5,907,622 | A | * | 5/1999 | Dougherty | 381/57 |
| 5,907,824 | A | * | 5/1999 | Tzirkel-Hancock | 704/242 |

(Continued)

FOREIGN PATENT DOCUMENTS

| | | |
|---|---|---|
| WO | WO8402793 | 7/1984 |

*Primary Examiner*—Susan McFadden
*Assistant Examiner*—Michael N. Opsasnick
(74) *Attorney, Agent, or Firm*—Ostrolenk, Faber, Gerb & Soffen, LLP

(57) ABSTRACT

The amount of data produced in the process of recording even short hearing samples by means of a monitor (1) may be considerably reduced by effecting a normalization to a range of values D and a subsequent nonlinear mapping to a second, preferably smaller range of values W. The result may be stored in an electronic memory. Further preferred measures are the spitting of the hearing samples into e.g. 6 signals each of which contains a respective frequency band of the original signal, and the conversion of the original amplitude values into energy variation values with simultaneous low pass filtering. Preferably, all cited processing steps are performed by a signal processor (9). A continuous recording time of up to 14 days by a monitor in the form of a wristwatch can thus be attained with state-of-the-art technology.

33 Claims, 3 Drawing Sheets

U.S. PATENT DOCUMENTS 5,937,377 A * 8/1999 Hardiman et al. ..... 704/225
5,960,091 A * 9/1999 White et al. ..... 381/98
6,175,634 B1 * 1/2001 Graumann ..... 381/94.1
6,233,549 B1 * 5/2001 Mauro et al. ..... 704/207
6,496,798 B1 * 12/2002 Huang et al. ..... 704/230

* cited by examiner

METHOD FOR THE COMPRESSION OF RECORDINGS OF AMBIENT NOISE, METHOD FOR THE DETECTION OF PROGRAM ELEMENTS THEREIN, AND DEVICE THEREOF

BACKGROUND OF THE INVENTION

The present invention refers to a method for the compression of an electric audio signal which is produced in the process of recording the ambient noise by means of an electroacoustic transducer, more particularly a microphone. Furthermore, the invention also refers to a device for carrying out the method.

In the field of audience research, which also comprises the acoustic perception of other media such as e.g. television, recordings of the acoustic environment of a panelist in a survey are used, i.e. the so-called hearing samples. The storage of these hearing samples on portable magnetic tape recorders is disclosed in U.S. Pat. No. 5,023,929. The inconvenient of this method is that the tape recorder is relatively large although it is intended to be permanently carried by the participant.

Consequently, it would be preferable to integrate the hearing sample recorder or monitor in an appliance which is normally worn or at least less visible. Such a possibility, namely the integration into a wristwatch, is mentioned in EP-A-0 598 682 to the applicant, this application being hereby incorporated into the present specification.

However, the mentioned application does not indicate how the hearing samples can be stored in the extremely narrow space and with the very limited energy available in a wristwatch or a similarly inconspicuous appliance over a considerable period of time such as at least a week. Although the specification mentions the need of compression procedures, known methods only are indicated.

SUMMARY OF THE INVENTION

It is therefore an object of the present invention to provide a method for the compression of hearing samples which in particular allows to obtain a high compression with minimal efforts with the safe recognition of program elements being essentially conserved.

This object is attained by a method for the compression of an electric audio signal which is produced in the process of recording the ambient noise by means of an electroacoustic transducer, more particularly a microphone, wherein

- the amplitude of said audio signal or of a derived digital or analog signal is normalized to a first predetermined range D;
- said audio signal is mapped in the form of a non-linear mapping onto a second predetermined range of values W in order to obtain an emphasis of sensitive values; and
- the result is stored in an electronic memory in a digital form.

In the following, the same terminology as in EP-A-0 598 682 will be used. A hearing sample is basically a recording of the ambient noise e.g. by means of a microphone. In order to simplify the storage as well as the transmission to the evaluating center, however, it is preferred to have a succession of short recordings of the ambient noise or hearing samples which are recorded at certain times. Preferably, the recordings are effected at regular intervals of e.g. 1 minute, and have a constant duration of the order of, for example, 4 seconds, the information of the time of the recordings being stored together with the hearing sample.

According to the invention, the hearing samples are finally stored in an electronic memory in a digitized form. According to the invention, in order to reduce the amount of data to be stored, a normalization of the hearing samples in their original form or in a derived form (filtered, limited to selective frequency bands, digital or analog, etc.) to a predetermined range (of values or amplitudes) D and a subsequent nonlinear transformation on a second range W is effected whose result, which is limited to the range W, is then stored in an electronic memory. The range W may be smaller or equal to D, but it is preferably substantially smaller.

Essentially, the non-linear transformation serves the purpose of amplifying sensitive areas of range D in such a manner that the more significant information provided by a signal whose value is comprised in such a sub-range of D is emphasized in the result, i.e. its resolution is increased. Preferred further developments of the invention are as follows:

A: The nonlinear mapping is characterized by a decreasing slope dW/dD for increasing values in D, e.g. similar to the logarithmic function. Essentially, the range of small values in D is thereby mapped onto a relatively larger range in W and thus emphasized, whereas relatively large values in D are mapped on a relatively small range in W only, i.e. their significance is attenuated.

B: The hearing samples are digitized immediately after recording (e.g. by a microphone) and analog processing (amplification; coarse filtering in preparation of the analog-digital conversion, etc.), resulting in a succession of numeric values. Each numeric value represents e.g. the momentary loudness of the ambient noise at a determined time.

Further processing is effected digitally by digital circuits, program controlled processors, or combinations thereof.

C: The amplitude or loudness values are transformed into energy values e.g. by squaring. The energy values are submitted to a low pass filtering and subsequently differentiated, the differentiation preferably being simulated by a difference calculus. The resulting energy variation values indicate the variation of the low-frequency proportion of the energy content in time.

D: The group of the energy variation values of a hearing sample, or only a part thereof, is normalized with respect to the maximum value of the values within the (partial) group. For this purpose, the maximum value is determined and all values of the group are divided by this maximum value. Simultaneously, the normalized values are mapped on a given range of numbers corresponding to the range D, e.g. the numbers between −128 and +127, so that the following arithmetic operations involve only integers. The number of values in these numerical ranges D is therefore preferably equal to powers of 2 (in the example: $256=2^8$ values) which are particularly advantageous in the case of binary digital processing. In order to perform this combination of normalizing and of imaging, the values of a group are multiplied by a factor which results from the division of the limit of the numeric range (i.e. 128 in the example) by the maximum value within the group.

E: The results of this step are again mapped on a further, smaller range of values W, e.g. the numerical range from 0 to 15 comprising $2^4=16$ numbers. On account of the fixed and relatively small number of values of the input data of this step, a so-called look-up table may be used for this second mapping.

Overall, it follows from the preceding that each numerical value of the hearing samples is reduced to a relatively short binary number (of 4 bits in the example).

F: Further optimizations are applied, such as e.g. taking the mean value of a plurality of values, only the mean value being further used. This also results in an important reduction of the number of values to be processed. On the digital level, such a filtering is simulated by a convolution.

G: Before or after being digitized at the input, the hearing sample is split into frequency bands or band signals. In a known manner, digital filterings may be effected by convolutions, and since the preferred convolutions represent low pass filterings, it is preferable to transmit less values to the following processing stages than are used for the convolution, preferably only one respective value.

BRIEF DESCRIPTION OF THE DRAWINGS

The invention will be explained in more detail hereinafter by means of an exemplary embodiment and with reference to figures.

DETAILED DESCRIPTION OF THE INVENTION

Figure 1:
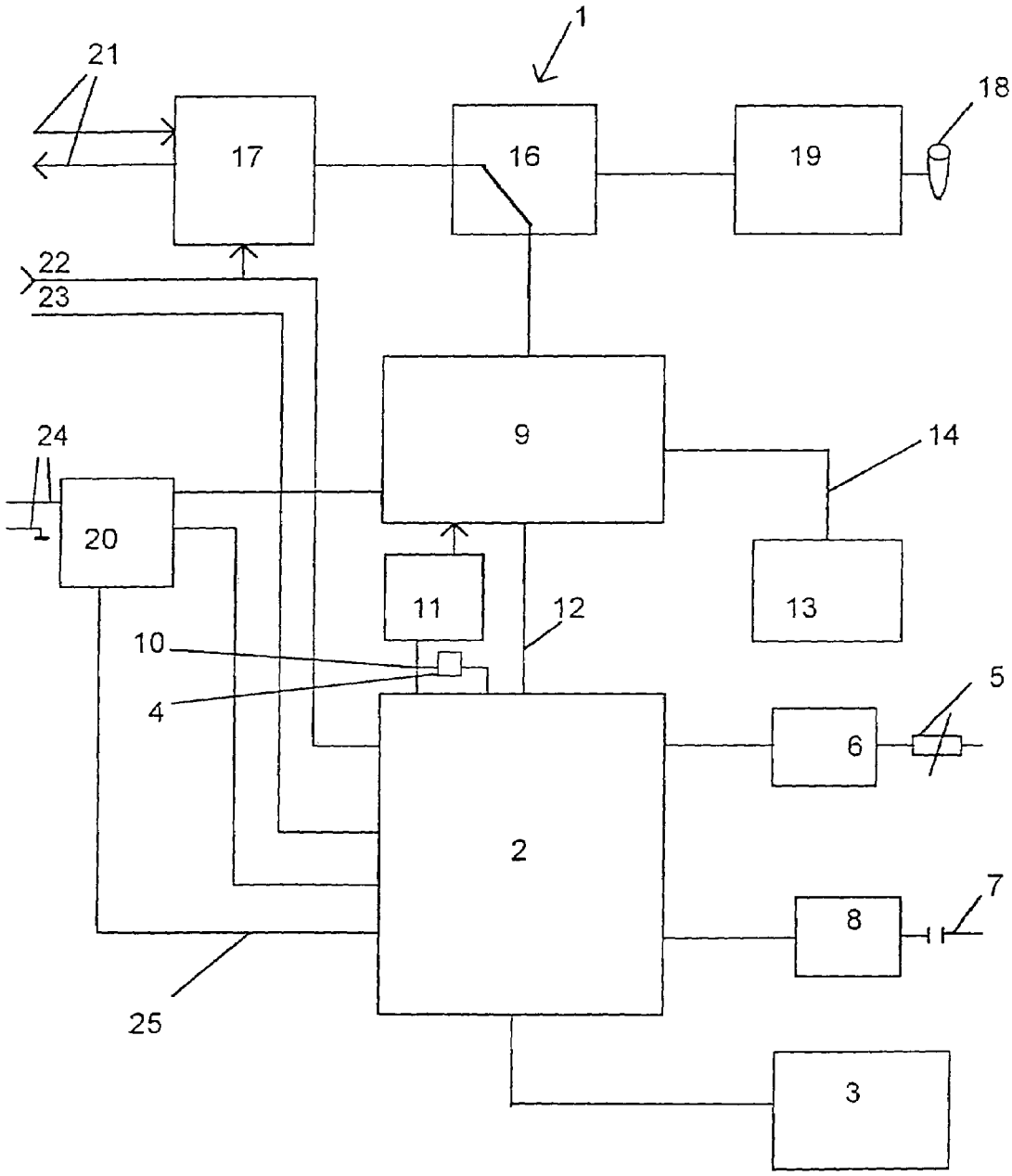
FIG. 1 shows a block diagram of a monitor according to the invention.

FIG. 1 shows a block diagram of a monitor 1. It may e.g. be intended to be integrated in a wristwatch, which is why monitor 1 comprises a clock circuit 2 which also serves as a time base for the signal processing, as well as a (liquid crystal) display 3. Commercially available components may be used for circuit 2 and display 3. A precise clock signal is generated by a quartz 4 in conjunction with an oscillator circuit which is integrated in clock circuit 2. Since a highly precise timing is required for the synchronization of the hearing samples to the comparative samples, a temperature compensation is provided in addition. The latter comprises a temperature sensor 5 which is connected to the clock circuit by means of an interface circuit 6. Interface circuit 6 essentially comprises an A/D converter.

Another important element for the monitor function is wearing detector 7. It may essentially consist of a sensor area on the wristwatch which detects the contact with the skin of the wearer. In the example, wearing sensor 7 is connected to clock circuit 2 by means of an interface circuit 8, which implies that the clock circuit is capable of providing the time indications with an additional mark from the wearing sensor. It is also conceivable to directly connect the wearing sensor to the proper monitor circuit, e.g. to digital signal processor 9.

The clock signals which are required for the signal processing, in particular for signal processor 9, are derived from the time base clock, which is taken from a connection 10 of quartz 4, by a PLL (phase locked loop) circuit 11. The time and the date as well as the mark from the wearing sensor, as the case may be, are transmitted from clock circuit 2 to digital signal processor 9 by a serial data connection 12.

The hearing samples are stored in a flash memory. It is an important advantage with respect to the present application that flash memories are capable of storing data in a non-volatile manner and of deleting them again without the need of particular measures. A bus 14 allowing to transmit both data and addresses serves to connect flash memory 13 and signal processor 9.

A multiplexer 16 is connected by a second serial connection. Depending on the operational condition, the multiplexer connects signal processor 9 to the recording unit of the hearing samples or to interface circuit 17 by means of which the data exchange with the evaluating center is effected.

The recording unit consists of a microphone 18 and a following A/D converter unit 19 which in addition to the proper A/D converter may comprise amplifiers, filters (anti-aliasing filters) and other usual measures in order to ensure a digital signal which represents the recording by the microphone as correctly as possible.

Power supply 20 may be a battery (lithium cell) or the like. An accumulator in conjunction with a contactless charging system by means of electromagnetic induction or a photo cell is also conceivable.

To ensure the connection to the exterior, more particularly for the transmission of data to the evaluating center, monitor 1 is provided with a bidirectional data connection 21, a reset input 22, a synchronization input 23, and a power supply terminal 24. The presence of a power supply at terminal 24 is also used to make the monitor change to the data transmission mode. For example, the monitor may be connected to a base station which establishes a connection to an evaluating center e.g. by telephone. Another possibility consists in mailing the monitor to the center where it is connected to a reading station. On this occasion, besides the data transmission, a synchronization of clock circuit 2 to the clock of the center may be effected, as previously described in EP-A-0 598 682.

As shown in the illustration, the hearing sample processing unit including signal processor 9 and the necessary accessory components (multiplexer 16, memory 13, clock generator consisting of PLL circuit 11 and quartz 10, etc.) may be composed of discrete components. In order to be incorporated in a wristwatch, however, the functions must be integrated in as few components as possible, which may result in a single application specific circuit 30 in the extreme case. For example, signal processors of the TMS 320C5x series (manufacturer: Texas Instruments) may be used, in which multiplexer 16 is already contained, inter alia, and Flash RAMs of the type AM29LV800 (manufacturer: Amdahl) having a capacity of 8 MBit. Such a memory capacity and the application of the compression method for hearing sample data according to the invention as described hereinafter allow to attain an uninterrupted operation of the monitor for approx. 7 days.

In view of energy consumption, it is advantageous if the hearing sample processing unit, more particularly signal processor 9, is only periodically switched on. If e.g. one hearing sample per minute is taken, it is sufficient according to the processing method of the present invention to switch on the power supply of the signal processor for some seconds (less than 5, e.g. 4 seconds) only. For this purpose, the power supply receives an on-signal 25 from clock circuit 2 during whose presence the hearing sample processing unit is supplied with current. A further reduction of the energy consumption is obtained by the fact that flash memory 13 is only supplied with the current required for the storing process for a short time, 3 milliseconds at the end of each processed hearing sample recording being sufficient in the case of the above-suggested type. The signal required therefor is generated by signal processor 9 and transmitted along bus 14. The program controlling the signal processor is contained in a separate program memory which may be integrated in the signal processor itself, so that the hearing sample processing operation can also be performed while flash memory 13 is off.

Figure 2:
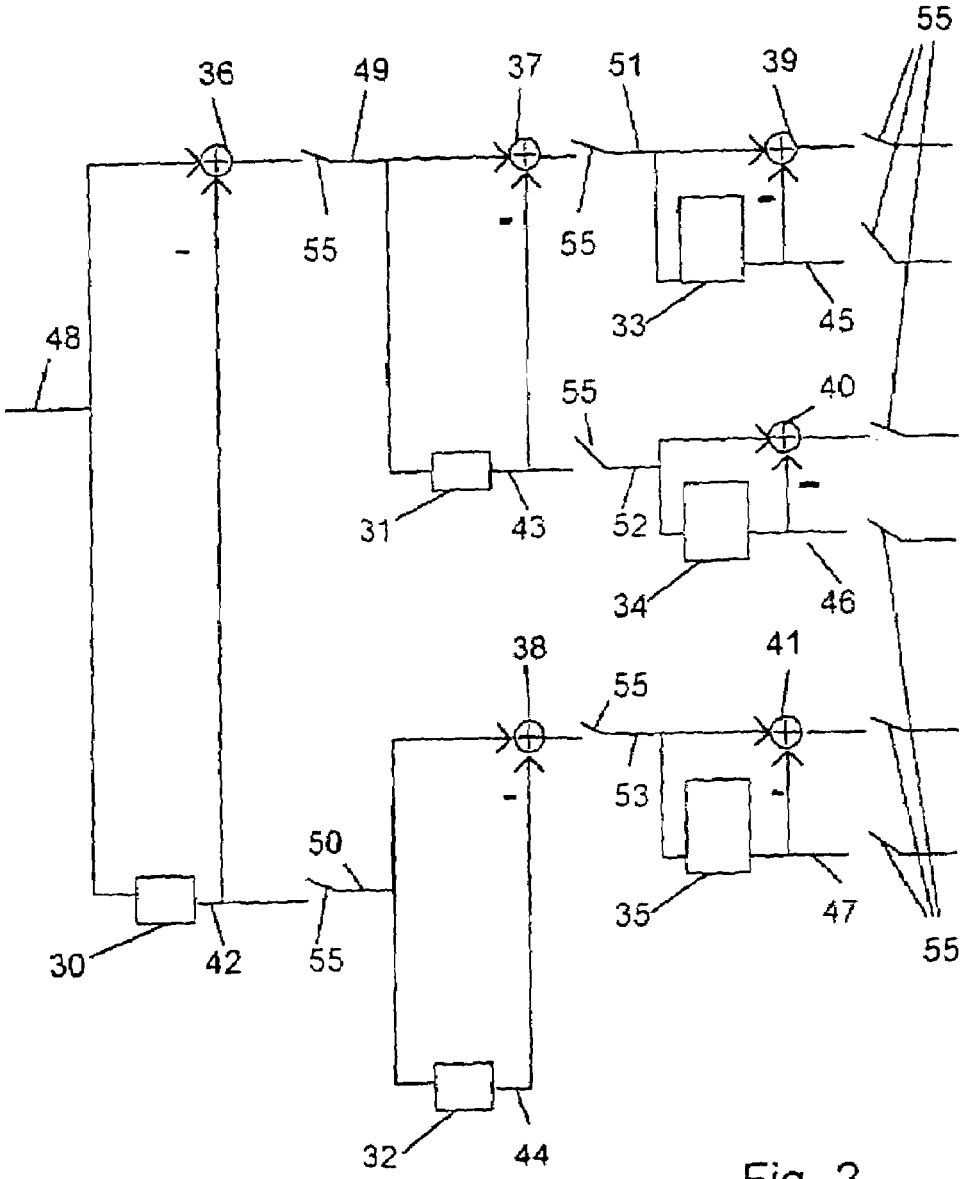
FIG. 2 shows the division into frequency bands.

Hereinafter, the method for the processing of the hearing samples is described. After the recording of the ambient noise (microphone 18) and its analog-digital conversion according to known principles (A/D converter unit 19), a splitting into e.g. six frequency bands is performed (FIG. 2)

which is effected by a hierarchical arrangement of low passes 30–35. The required high pass associated to each low pass is realized by a subtraction 36–41 of the output signals 42–47 from the respective input signals 48–53 of the low passes, the subtraction being effected by an addition of the inverted output signals 42–47 of low passes 30–35.

Low pass filters 30 to 35 are realized by a 19-digit convolution:

$$y_j = \sum_{i=0}^{18} a_i x_{j-i} \tag{1}$$

where j: time index $y_j$: output value of the low pass filtering at the time j;

$x_j$: input value for low pass filtering at the time j;

$a_i$: coefficient of the convolution sequence;

$a_0 \ldots a_{18}$: [0.03, 0.0, −0.05, 0.0, 0.06, 0.0, −0.11, 0.0, 0.32, 0.50, 0.32, 0.0, 0.11, 0.0, 0.06, 0.0, −0.05, 0.0, 0.03]

In the course of the splitting into the frequency bands or band signals (54), a first data reduction is already effected in that only every second value out of each sequence of output values of the high and low pass filterings is transmitted to the following low resp. high pass stage or to outputs 54 by the switches 55. Overall, this already allows to obtain a reduction of the data volume to ⅛. With the division into six bands used in the example, this results in a slight overcompensation of the accompanying increase of the data volume by a factor six.

A criterion for the design of the filters is that one band may contain the contents of every other band in a clearly attenuated form at the most. A reduction to the half at least may be considered as clearly attenuated. Ideally, the bands only contain residual portions of directly adjacent bands, portions which are near or below the resolution of the digital numerical representation even. In the preferred digital realization, this aim is attained by low pass filtering (convolution) and subsequent subtraction of the filtered proportion from the input signal of the low pass filter.

Figure 3:
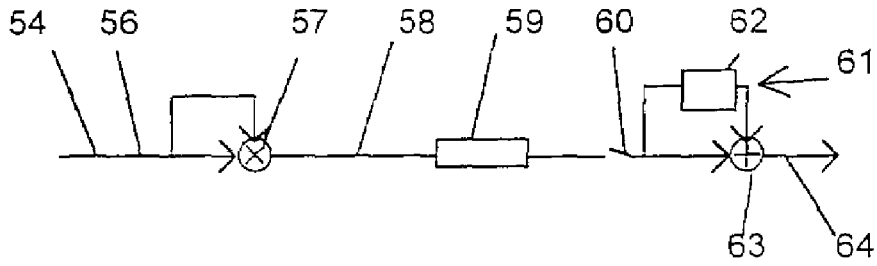
FIG. 3 shows the conversion into energy values and the differentiation.
Figure 4:
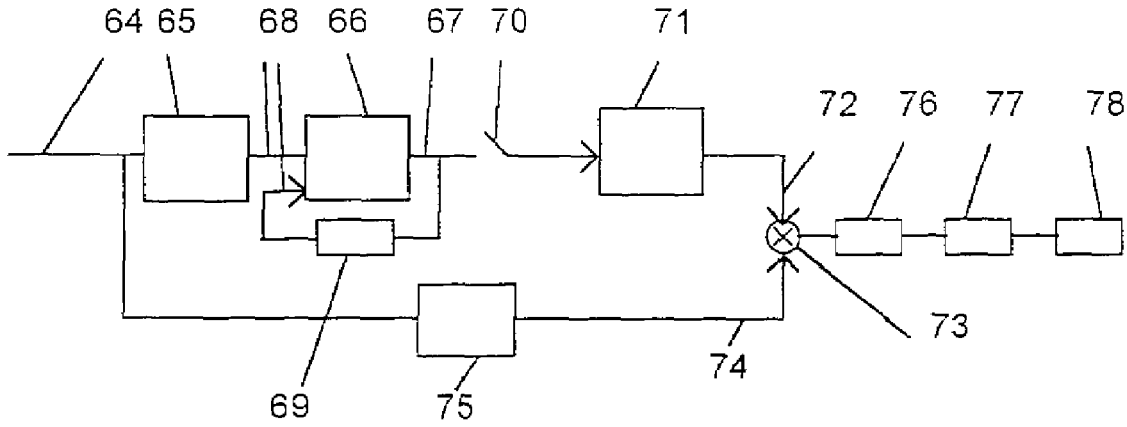
FIG. 4 shows the "normalizing quantization".

The treatment of the band signals 54 resulting from the division into bands is identical in each band, FIGS. 3 and 4 showing the processing of only one band 56 in a representative manner.

Input signal 56, which is identical to output signal 54, is first squared in that it is supplied to the two inputs of a multiplier 57 in parallel. Except a proportionality factor, this squaring corresponds to a calculation of the energy content of the proportion of the ambient noise which is represented by signal 56. Energy values 58 are subjected to a low pass filtering. This filtering is realized by means of a convolution over 48 values:

$$y^e_j = \sum_{i=0}^{47} b_i x^e_{j-i} \tag{2}$$

where

| | |
|---|---|
| j | time index of the $y^e$ and $x^e$ values; |
| $x^e_j$ | energy value 58 at the time j; |
| $y^e_j$ | output signal of the low pass filter 59 at the time j; |
| $b_i$ | the coefficients of the convolution sequence, wherein $b_0 = b_1 = \ldots b_{47} = 1.00$. |

Of the output values of low pass filter 59, only every 48th value is forwarded to the following differentiation 61 by switch 60. Overall, here, a data reduction to 1/48 of the input data volume is obtained by the formation of a mean value.

In differentiator 61, each incoming value is delayed by a time unit in delay unit 62. Delay unit 62 may e.g. be a FIFO waiting queue having a length of 1.

In adder 63, the undelayed values are added to the inverted, delayed values, so that the values of the differences between two successive input values of the differentiator 61 are available at the output 64. The differences refer to a determined, constant and known time shift which is given by the time units, and consequently represent an approximation of the derivative with respect to time.

The energy difference values 64 are subjected to the normalized quantization. On one hand, according to FIG. 4, the absolute value of the energy difference values is formed in absolute value unit 65. These absolute values are supplied to a maximum value detector 66 at the output 67 of which the greater one of the values supplied to its inputs 68 appears. Since the output signal from output 67 is fed back to one of the two inputs 68 by a single-stage delay circuit 69, the maximum value of all values received by absolute value unit 65 is formed at output 67. The maximum values pass through another switch 70 which only transmits every 32nd value, i.e. a value which is the greatest within a hearing sample (the hearing sample duration used in this embodiment results in 32 energy difference values 64 per hearing sample in each frequency band).

In a reciprocal-computing and multiplication unit 71, the number 128 ($=2^7$) is divided by the maximum value of the hearing sample and the result is supplied to an input 72 of a multiplicator 73. The other input of multiplicator 73 is then successively supplied with the energy difference values 64 among which the maximum value has been determined. For this purpose, the difference values 64 are temporarily stored in a FIFO buffer 75. The result of the multiplication in multiplicator 73, whose values are comprised between −128 and +127, is converted by converter 76 into integers in the range D from 0 to 255, corresponding to a byte having 8 bits. These numbers are used as addresses in a look-up table (LUT) 77 where a number in the range W=0 to 15, i.e. a four-digit binary number, is associated to each input value. The discrete mapping of 8-bit numbers onto 4-bit numbers performed in LUT 77 is nonlinear and so designed that the resolution of small input numbers is finer than that of greater input values, i.e. that small input values are more emphasized. This may be referred to as a non-equidistant quantization.

The 4-bit values from output 78 are stored in flash memory 13 (FIG. 1).

The described normalized, non-equidistant quantization and compression unit is provided for each band according to the illustration of FIG. 3, resulting in 4-bit values for a total of 32×48×8=12,288 values per processing cycle which are recorded by the A/D converter at input 48 (FIG. 2). With an A/D conversion rate of 3,000 to 5,000 conversions per second, as provided by the currently available A/D converters of the lowest power consumption, this results in a hearing sample duration of approx. 2.5 to 4 s. With a supposed rate of one hearing sample per minute, the necessary memory capacity for the data amounts to 32×6×4=768 bit/min or 1'105'920 bit/d. The indicated 8 Mbit memory thus allows to record approx. 7 days of uninterrupted operation of the monitor.

In view of a reduction of the required computing, all cited calculations are effected by integer or fixed point arithmetic unless especially indicated, in particular an exponential representation of floating point numbers is avoided. The number of bits used for the representation of a number essentially depends on the used processor and on the data length provided by the latter. The above-mentioned processor family TMS320C5x uses 16-bit arithmetic. The binary point for fixed point arithmetic is set in such a manner that the limited computing accuracy is optimally utilized in each processing step although the probability of a data overflow is extremely low. Therefore, the binary point is set differently in the different processing steps. In the preferred embodiment of the band division, the least significant bit represents the value 2–16 for the filter coefficients and the value 20 for the data values. Energy conversion and energy filtering are calculated by 32-bit integer arithmetic which is implemented as standard library function calls.

Prior to the storage in the flash memory or alternatively in the evaluating center, usual compression methods may be additionally applied which allow restoration of the original data in an identical form when decompressed.

In preparation of the recognition of the program elements which are possibly contained in the hearing samples, program samples are as exactly simultaneously as possible taken, e.g. directly at the broadcasting station, and stored. Prior to their comparison, the program samples are preferably subjected to the same processing and compression process as the hearing samples. This may be the case before the storage or only at the time of reading resp. playback of the stored program samples.

For the recognition, one of the usual correlation methods may be used. It is also possible to apply a coarse correlation using a fast computing procedure first and to perform a more precise and complicated correlation only if a sufficient probability of the presence of a given hearing sample has been found. In particular, such a preceding coarse correlation also provides a first coarse estimate of a subsisting minimal time shift between the hearing sample and the reference samples recorded at the station. In the more complex procedure, finer time shifts are analyzed and a more rugged comparison method is applied which takes account of the statistical distribution of the program signal and of interference signals.

Essentially, in the course of the evaluation, the simultaneous captured samples of each program as recorded each by a stationary unit are compared to the hearing samples of each monitor. An exemplary comparison method is illustrated in the following pseudocode which describes the correlation of a hearing sample of a monitor:

```
Decompress Data of the Monitor
OptimumMatch:=−1
FOR StationaryUnit := 1 TO NumberOfStationaryUnits DO
    Load digitized program samples which have been recorded at
    the same time as the hearing samples of the monitor;
    Apply same preliminary processing as to hearing samples;
    FOR TimeShift := 1 TO MaxTimeShift STEP Timestep DO
    {Takes account of running inaccuracies of the timers by a
    step size of Timestep}
    Calculate matching coefficient c_t with standard correlation for the
    actual time shift and assign result to the variable ActualMatch;
        IF (ActualMatch > OptimumMatch) DO
            OptimumMatch := ActualMatch;
            OptimumTimeshift := TimeShift;
            OptimumStationaryUnit := Stationary Unit;
        ENDIF
    ENDFOR
ENDFOR
```

-continued

```
IF(OptimumMatch>Threshold) DO
    RadioStation is recognized;
    The correct station is stored in the memory OptimumStationaryUnit
ELSE
    None of the surveyed reference programs was heard at this time
ENDIF
```

In this procedure, only one of the radio programs registered in 'NumberOfStationaryUnits' is determined in the hearing sample of a monitor, namely the one which yields the highest probability (value of the variable 'OptimumMatch').

In particular, the optional, univocally reversible compression of the hearing samples processed according to the invention is reversed. This is followed by the initialization of 'OptimumMatch' to the lowest value which also indicates "no match", i.e. the wearer of the monitor has listened to none of the monitored programs.

The program samples of each stationary unit simultaneously recorded with the current hearing sample (loop "For StationaryUnit:=1 to NumberOfStationaryUnits . . . EndDo" are loaded and processed in the same manner as the hearing sample. Due to subsisting small time shifts between the hearing samples and the program samples, the following comparison is performed for a certain number 'MaxTimeShift' of assumed time shifts (loop "For TimeShift:=1 to MaxTimeShift . . . Endfor"). The comparison is effected by a standard correlation of program and hearing sample data which are shifted forwards or backwards with respect to each other according to the 'TimeShift' variable. In order to always allow a full correlation over all values of the hearing sample, the program samples are therefore recorded over a longer period per sample, the beginning being additionally set earlier in time by the corresponding maximum time shift. Correspondingly, the length of the program sample is chosen in such a manner that the hearing sample is still completely contained in the program sample time even if the beginnings of the program sample and of the hearing sample are maximally displaced.

The normalized correlation is performed according to the following formula:

$$c_t = \frac{\sum_{i=1}^{N} (s_i m_{i-t})}{\sqrt{\sum_{i=1}^{N} (s_i)^2} \sqrt{\sum_{i=1}^{N} (m_{i-t})^2}} \quad (3)$$

where

| | |
|---|---|
| t | time shift index (= 'TimeShift' in pseudocode); |
| N | number of correlated values, generally equal to the number of values in a hearing sample; |
| i | time index; |
| $s_i$ | hearing sample value at the time i; |
| $m_{i-t}$ | program sample value at the time i, displaced by t time steps; |
| $c_t$ | correlation value for the time shift t: $-1 \leqq c_t \leqq 1$. |

The $c_t$ values for different t values and program samples are compared, and the greatest $C_t$ value overall is stored along with the indications of the conditions in which it has been recorded. These indications consist of the time shift, the stationary unit, i.e. the program, and of the correlation value $c_t$ itself.

If the so determined greatest $c_t$ value is superior to a predetermined threshold value, the corresponding program is considered to be contained in the hearing sample. If the threshold value is not attained, it is assumed that no one of the programs was heard.

Since the correlation must be performed correspondingly often due to the considerable scope of time shifts (t resp. TimeShift), a simplified alternative is conceivable where the time intervals are treated with a coarser graduation. For those $C_t$ values which exceed a predetermined threshold, the correlation is repeated with a more rugged method while taking account of all detected time shifts.

A suitable rugged correlation is $$r_t = \frac{\sum_{i=1}^{N} |s_i - a * m_{i-t}|}{\sum_{i=1}^{N} |s_i|} \tag{4}$$

where

| | |
|---|---|
| $r_t$ | "rugged" correlation value; |
| a | scaling factor which takes account of the attenuation of the program signal with respect to the hearing sample; |

the remaining symbols corresponding to formula (3).

The procedure thus essentially uses absolute values both of the deviation between the hearing sample and the scaled program signal and of the hearing sample signal. The scaling factor a is iteratively determined in such a manner that the rugged correlation value $r_t$ becomes minimal. Compared to the normal correlation, large deviations are less weighted in the rugged correlation, thus taking account of statistical distributions of hearing sample values and of program signal values and therefore resulting in better recognition rates for real signals than the normal correlation value $c_t$. In particular, individual hearing samples with large deviations are less weighted.

Tests show that the described method not only eliminates or at least strongly reduces known interference effects such as secondary noise and time shifts but that damping (speakers, transmission lines, general acoustic conditions) and echo as well have only little influence on the recognition of a program. It has been particularly surprising to find that the program could often be detected in the hearing samples even when the program element was inaudible. The suppression of echo effects is attributed to the formation of a temporal mean (filter 59), in particular, especially if its time constant is chosen in such a manner as to be greater than the echo times usually found in a normal environment. A typically frequency-dependent (acoustic) damping is compensated by the described suitable combination of a division into frequency bands, a normalization to the maximum value, and in taking into account of the damping by means of the scaling factor a in the calculation of $r_t$ or by the calculation mode of $c_t$.

Modifications of the exemplary embodiment within the scope of the invention are apparent to those skilled in the art.

According to the technological development, different components (signal processors, memories, etc.) may be used. Alternatives are conceivable in particular for the flash memory, e.g. battery-backed up CMOS memories. The criteria, especially for portable monitors such as wristwatches, are an extended uninterrupted monitoring period and a minimal energy consumption. In certain circumstances it may be better to use a fast processing unit having a higher power dissipation if the higher energy consumption with respect to a slower unit is more than compensated by only temporary operation with intermediate inactive pauses. Besides the complete shut-off, many components such as e.g. the TMS320C5xx also offer special power saving modes. Also, the reduction of the clock rate of a fast unit often allows an important reduction of the energy consumption.

Depending on the used technology, different degrees of accuracy or numbers of digits of the binary numbers may be used. In tests, a sufficiently safe program recognition has been obtained with 4-bit end results. It is also conceivable, however, to effect a reduction to 3 bits, or to provide a greater number, e.g. 6 bits, 7 bits, or 8 bits. Greater numbers of binary digits are possible in particular if shorter wearing times are allowed or if memories of greater capacity become available.

In the case of higher numbers of digits of the end result, it may also be necessary to increase the number of digits in the preceding steps to the number of digits of the end result at least.

Mostly, the exact values for the nonlinear mapping by table 77 as well as the threshold values for the weighting of the correlation values can only be determined empirically. Although a function similar to a logarithmization is preferred, other functions are possible. It is also conversely conceivable to emphasize the greater values in D and to suppress the small values of the energy differences.

The factors and the number of digits of the convolutions may as well be chosen differently, and a different number of frequency bands into which the hearing samples are split is possible. In particular, it is conceivable in the case of modified A/D conversion speeds, different settings with respect to echo and/or damping compensation, or modified hearing sample durations, to adapt low pass 59, e.g. by changing the number of tabs of the convolution.

It is also conceivable to perform the analog-digital conversion at a later stage of the compression, particularly if the corresponding analog circuits offer advantages with respect to the processing speed or the space consumption in the monitor. In the extreme case, the digitization might be effected only immediately prior to the storage in the memory. If an analog signal is concerned, the term "digital value" in the description shall be replaced with e.g. the size or the amplitude of the signal.

With respect to the correlation, it is also possible to use only the part of the hearing samples which still lies within the corresponding program sample with the actual time shift t, e.g. if program and hearing samples of the same length are recorded.

An alternative of the wearing sensor consists of using currently available motion sensors. A known embodiment contains a contact which switches between the open and the closed state on motion but remains in one of the two states in the absence of motion.

Glossary

Flash RAM RAM (see there) which also conserves data in case of power failure but allows faster storage and easier erasure than classic non-volatile memories (PROM/EPROM).

RAM read/write memory time index number of a digital value in the succession of values leaving the digitizer (A/D converter), mostly in relation to the beginning of a hearing sample, whose associated value has the time index 0.

What is claimed is:

1. A method for storing an electric signal representing recorded ambient noise in compressed form, the method comprising:

periodically recording samples of the ambient noise using a sound transducer, the sample duration being shorter than the sampling cycle;

dividing the recorded audio signal into at least two band signals by filtering, with each one of the band signals containing a frequency range of the audio signal, and wherein any content of the other band signals contained in each band signal is present only in an attenuated form;

normalizing the amplitude of the divided audio signal within a first predetermined range D;

mapping the normalized amplitude values of the sampled ambient noise onto a second predetermined range of values in the time domain using a non-linear mapping function to obtain an emphasis of selected values ranges within the first or the second predetermined ranges; and storing the mapped result in an electronic memory in a digital format.

2. The method of claim 1, wherein the band signals essentially contain frequency ranges of the same width each, and all frequency ranges are comprised in the range of 500 Hz to 10,000 Hz.

3. The method of claim 1, wherein any content of the other band signals contained in each band signal is attenuated to half of their respective original levels.

4. The method of claim 1, wherein any content of the other band signals is completely attenuated from each band signal so as to not be present at all therein.

5. The method of claim 1, wherein the audio signal is divided into from 3 to 15 band signals.

6. The method of claim 5, wherein the audio signal is divided into from 4 to 10 band signals.

7. The method of claim 5, wherein the audio signal is divided into from 5 to 8 band signals.

8. The method of claim 5, wherein the audio signal is divided into 6 band signals.

9. The method of claim 1, wherein the band signals are generated by splitting once or a cascaded multiple of times an input signal which is either the audio signal or an output signal obtained according to the following steps:

first low pass filtering to generate a first output band signal, and subtracting the first output band signal from the input signal to generate a second output band signal.

10. The method of claim 9, wherein all first low pass filterings have a same Q-factor.

11. The method of claim 9, wherein the input signal is digitized and only every nth value of each division stage is added to the band signal, n being greater than or equal to 2, in order to compensate for the increased data volume resulting from the splitting into band signals.

12. The method of claim 11, wherein n is equal to 2.

13. The method of claim 9, wherein the low pass filtering is realized by means of a digital convolution over 10–30 values.

14. The method of claim 13, wherein the low pass filtering is realized by means of a digital convolution over 15 to 25 values.

15. The method of claim 13, wherein the low pass filtering is realized by means of a digital convolution over 19 values.

16. The method of claim 13, wherein for the purpose of the low pass filtering, the convolution is performed according to the relationship:

$$y_j = \sum_{i=0}^{18} a_i * x_{j-i}$$

where:

j is the time index, $y_j$ is the output value of the low pass filtering at the time j;

$x_j$ is the input value for low pass filtering at the time j;

$a_i$ is the coefficient of the convolution sequence; and $a_0$–$a_{18}$ are [0.03, 0.0, −0.05, 0.0, 0.06, 0.0, −0.11, 0.0, 0.32, 0.50, 0.32, 0.0, −0.11, 0.0, 0.06, 0.0, −0.05, 0.0, 0.03].

17. A method for storing an electric signal representing recorded ambient noise in compressed form, the method comprising:

periodically recording samples of the ambient noise using a sound transducer, the sample duration being shorter than the sampling cycle;

normalizing the amplitude of a signal output of the transducer or a signal derived therefrom within a first predetermined range D;

mapping the normalized amplitude values of the sampled ambient noise onto a second predetermined range of values in the time domain using a non-linear mapping function to obtain an emphasis of selected values ranges within the first or the second predetermined ranges; and storing the mapped result in an electronic memory in a digital format; and generating an energy signal which is proportional to an energy content of the ambient noise from the audio signal or from a signal derived from the audio signal.

18. The method of claim 17, wherein the energy signal is generated by squaring said audio signal or said signal derived therefrom.

19. The method of claim 17, further comprising performing a subsequent differentiation of the energy signal with respect to time to obtain an energy difference signal.

20. The method of claim 19, wherein the differentiation is performed by computing the difference between two respective values of the energy signal.

21. The method of claim 17, wherein the energy signal is subjected to a second low pass filtering.

22. The method of claim 21, wherein the second low pass filtering is effected digitally in the form of a convolution over 20 to 70 values.

23. The method of claim 22, wherein the second low pass filtering is effected digitally in the form of a convolution over 40–55 values.

24. The method of claim 22, wherein the second low pass filtering is effected digitally in the form of a convolution over approximately 48 values.

25. The method of claim 22, wherein the convolution has coefficients which are essentially equal to each other.

26. The method of claim 22, wherein the coefficients of the convolution are equal to 1.0.

27. The method of claim 22, wherein the second low pass filtering is followed by a second data reduction where one energy value among n filtered values is selected, n being at least equal to 2.

28. The method of claim 27, wherein n is equal to the number of values of the convolutions of the second low pass filtering.

29. A method for storing an electric signal representing recorded ambient noise in compressed form, the method comprising:

periodically recording samples of the ambient noise using a sound transducer, the sample duration being shorter than the sampling cycle;

normalizing the amplitude of a signal output of the transducer or a signal derived therefrom within a first predetermined range D;

mapping the normalized amplitude values of the sampled ambient noise onto a second predetermined range of values in the time domain using a non-linear mapping function to obtain an emphasis of selected values ranges within the first or the second predetermined ranges; and storing the mapped result in an electronic memory in a digital format; wherein:

the range of normalized values D is defined by a lower limit $D_u$, and an upper limit $D_o$, and the normalization is effected by:

obtaining the maximum of the absolute value of the audio signal or the derived signal within the duration of normalizing the audio or derived signal, which is shorter than or equal to the duration of a hearing sample, multiplying the reciprocal value of said maximum by $(D_o-D_u+1)$, and multiplying this product by each value of the audio or derived signal within the duration of the normalized signal.

30. The method of claim 29, wherein $D_u$ is equal to 0.

31. The method of claim 29, wherein the duration of normalizing the audio or derived signal is equal to the duration of a hearing sample.

32. The method of claim 29, wherein $D_o-D_u$ is equal to $2^n-1$, n being a whole number greater than 4.

33. The method of claim 32, wherein n is equal to 7.

* * * * *